US005647309A

United States Patent [19]

Avery

[11] Patent Number: 5,647,309

[45] Date of Patent: Jul. 15, 1997

[54] INTERNAL COMBUSTION ENGINE FIRING SYSTEM

[76] Inventor: Alfred J. Avery, G-4121 Grandview Dr., Flushing, Mich. 48433

[21] Appl. No.: 661,862

[22] Filed: Jun. 11, 1996

Related U.S. Application Data

[63] Continuation of Ser. No. 347,726, Dec. 1, 1994, abandoned.

[51] Int. Cl.[6] ..... F02B 75/20

[52] U.S. Cl. ..... 123/58.8; 123/188.4

[58] Field of Search ..... 123/58.8, 90.15, 123/90.17, 90.31, 90.1, 188.4

[56] References Cited

U.S. PATENT DOCUMENTS

| | | | |
|---|---|---|---|
| 608,845 | 8/1898 | Diesel | 123/27 R |
| 713,367 | 11/1902 | Wallmann | 123/302 |
| 1,241,999 | 10/1917 | Learned | 123/58.8 |
| 1,245,188 | 11/1917 | Buckwalter | 123/27 R |
| 1,312,387 | 8/1919 | Connolly | 123/58.8 |
| 1,583,670 | 5/1926 | Davol | 123/531 |
| 1,632,223 | 6/1927 | Fey | 123/90.17 |
| 1,729,201 | 9/1929 | Attendu | 123/27 R |
| 1,892,635 | 12/1932 | Schwarz | 123/58.8 |
| 1,904,070 | 4/1933 | Morgan | 60/620 |
| 2,682,260 | 6/1954 | Lantz | 123/90.17 |
| 2,696,807 | 12/1954 | Junge et al. | 123/27 |
| 2,744,511 | 5/1956 | Kauffmann et al. | 123/120 |
| 3,113,561 | 12/1963 | Heintz | 123/90.17 |
| 3,406,666 | 10/1968 | Steiger | 123/27 |
| 3,450,109 | 6/1969 | Gratzmuller | 123/27 |
| 3,991,721 | 11/1976 | Hurd | 123/58.8 |
| 4,248,192 | 2/1981 | Lampard | 123/256 |
| 4,513,727 | 4/1985 | Lagano et al. | 123/525 |
| 4,641,616 | 2/1987 | Lampard | 123/256 |
| 4,787,343 | 11/1988 | Tuckey | 123/58.8 |
| 4,960,084 | 10/1990 | Akasaka et al. | 123/90.17 |

FOREIGN PATENT DOCUMENTS

| | | | |
|---|---|---|---|
| 2337509 | 2/1975 | Germany | 123/58.8 |
| 2548086 | 5/1977 | Germany | 123/58.8 |
| 2703933 | 9/1977 | Germany | 123/58.8 |

*Primary Examiner*—David A. Okonsky

*Attorney, Agent, or Firm*—Gifford, Krass, Groh, Sprinkle, Patmore, Anderson & Citkowski, P.C.

[57] ABSTRACT

A firing system for a multi-cylinder internal combustion engine propagates combustion between cylinders by the use of a valve located between an outlet port of one chamber and an inlet port of a second cylinder.

7 Claims, 2 Drawing Sheets

Fig-1
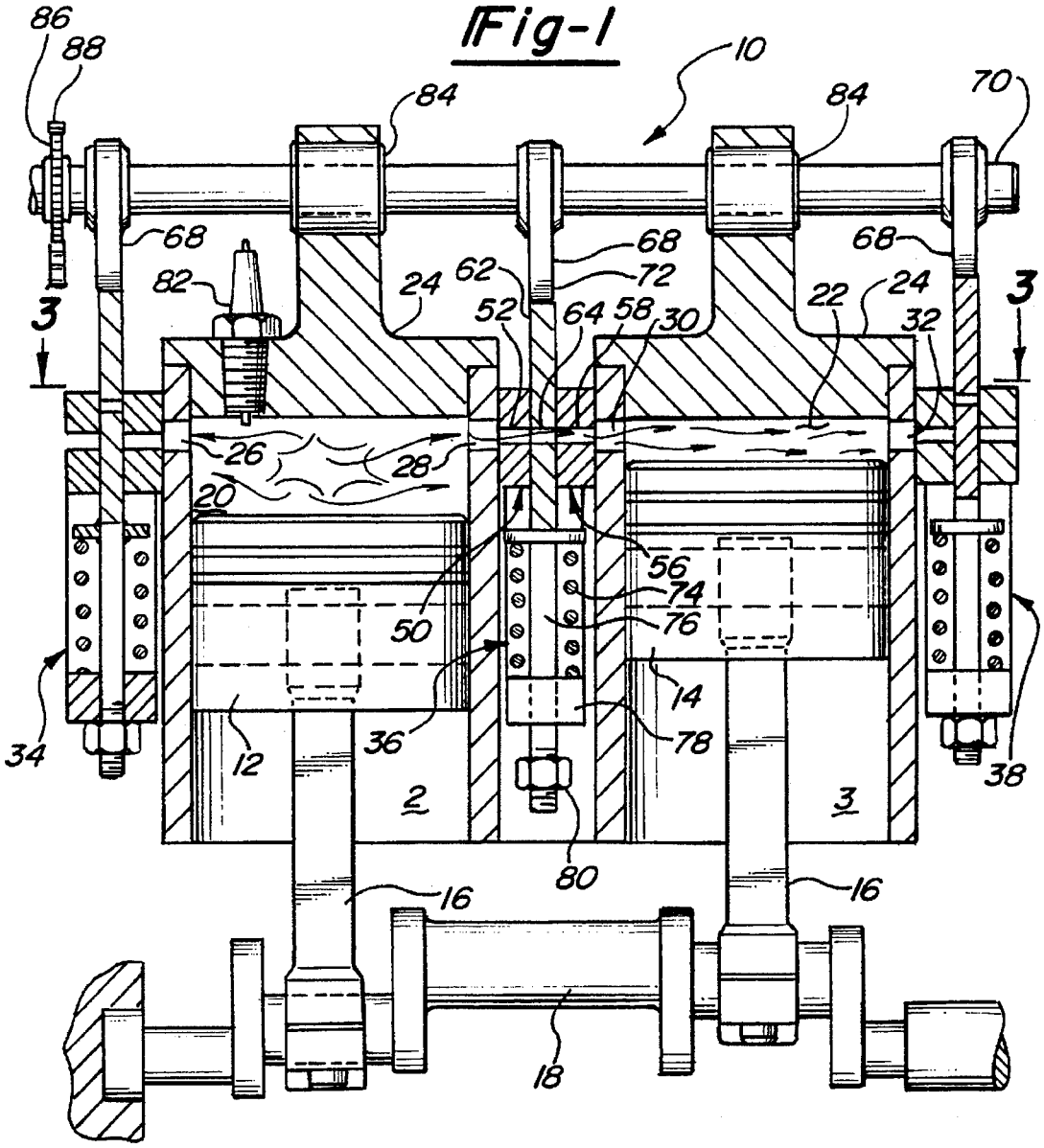
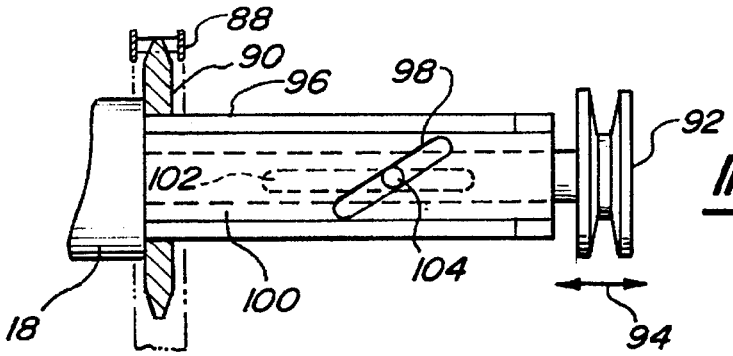
Fig-2

INTERNAL COMBUSTION ENGINE FIRING SYSTEM

This is a continuation of application Ser. No. 08/347,726 filed on Dec. 1, 1994 and now abandoned.

BACKGROUND OF THE INVENTION

1. Field of the Invention

This invention relates to internal combustion engines, and, more particularly, this invention relates to a firing system for multi-cylinder internal combustion engines.

2. Prior Art

Ignition is obtained in a conventional multi-cylinder internal combustion engine through the use of a spark plug or glow plug located in each combustion chamber so that the fuel air mixture in the chamber is ignited at its maximum compression point.

BRIEF SUMMARY OF THE INVENTION

The present invention eliminates the use of a spark plug in each cylinder, using a single spark plug in one cylinder to commence combustion and thereafter sequentially causing ignition in all of the cylinders by propagating the combustion from one chamber to the next. That is, the ignited fuel-air mixture in one cylinder passes into the second cylinder, igniting the fuel-air mixture in the second cylinder, and this ignition propagation fires all of the cylinders in a closed loop.

Thus the firing system of this invention as it is applied to a multi-cylinder internal combustion engine includes inlet and exit ports adjacent the top of each cylinder. Passages interconnect the exit port of one cylinder with the inlet port of the next cylinder. A valve is located in each of the passages and is sequentially opened and closed to allow the combustion in the first cylinder to commence combustion in the second cylinder by passing from the exit port of the first cylinder through one of the interconnecting passages and valves and through the inlet port of the second chamber. The valves are sequentially opened preferably by the use of a cam shaft operating in synchronism with the engine crank shaft.

The advantages of this new firing system are cleaner emission, higher gas mileage and the ability to run on a lower grade fuel.

DRAWING

A better understanding of the present invention will be had upon reference to the following detailed description when read in conjunction with the accompanying drawing, wherein like reference characters refer to like parts throughout the several views, and in which:

FIG. 1 is an elevational view in section showing a portion of a two cycle internal combustion engine to which the ignition system of this invention has been applied;

FIG. 2 is an elevational view of a portion of the crank shaft showing the device for adjusting the firing timing;

DETAILED DESCRIPTION OF THE PRESENTLY PREFERRED EMBODIMENT OF THE INVENTION

For simplicity, the firing system of my invention is shown applied to an eight cylinder, two cycle engine; however, it can be applied to many types of multicylinder engines.

Figure 3:
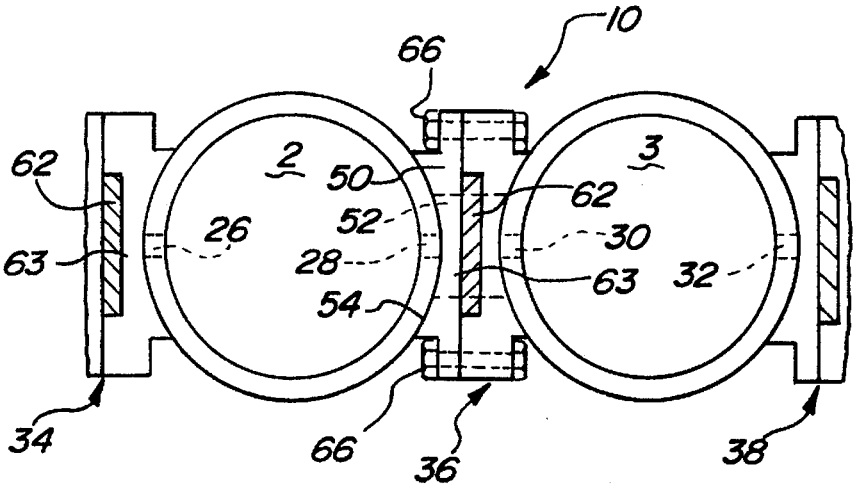
FIG. 3 is a sectional view taken along line 3—3 of FIG. 1.
Figure 5:
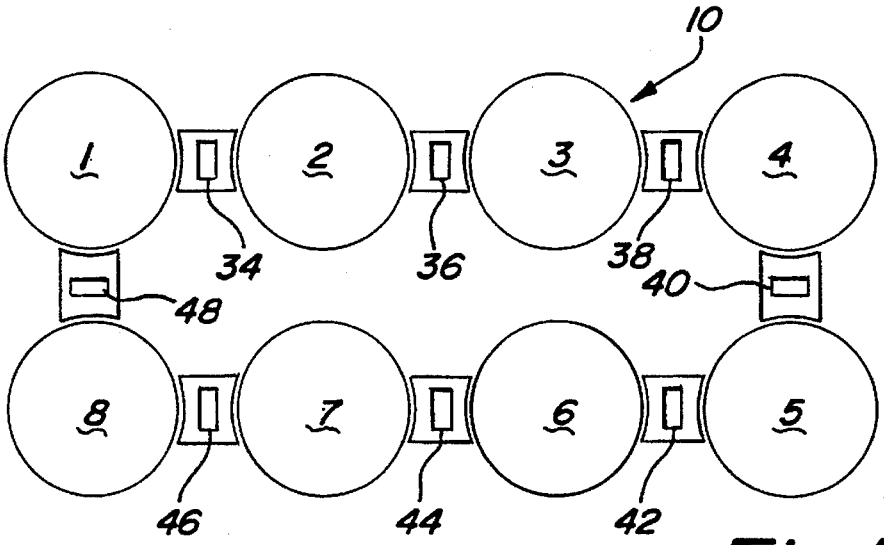
FIG. 5 is a schematic plan view of an eight cylinder internal combustion engine employing the firing system of this invention.

An internal combustion engine 10 shown partially in FIGS. 1, 3 and 5 has a number of serially arranged cylinders 1, 2, 3, 4, 5, 6, 7 and 8 as shown in FIG. 5, two of which cylinders, 2 and 3, are shown in FIGS. 1 and 3.

The cylinders 2 and 3 have pistons 12 and 14, respectively with connecting rods 16 at their lower ends connecting to crank shaft 18. Combustion chambers 20 and 22 are defined between the top end of the pistons 12 and 14 and the head portions 24.

Each of the cylinders has conventional intake and exhaust ports, not shown, for introducing a combustible mixture of fuel and air to the combustion chamber and exhausting burned gases from the combustion chamber.

To a conventional structure I have added an inlet port and an exit port at the top of each cylinder, shown at 26 and 28 for cylinder 2 and 30 and 32 for cylinder 3, respectively. These ports are arranged with respect to the cylinder walls so that the exit port of one cylinder is in-line with the inlet port of the next cylinder. As seen in FIG. 1, the exit port 28 of cylinder 2 is in-line with the inlet port 30 of cylinder 3. Between each of these in-line exit ports and inlet ports, a valve is interposed. Referring to FIGS. 1 and 5, valves 34, 36, 38, 40, 42, 44, 46, and 48 are located between the exit and inlet ports of adjacent cylinder pairs 1 and 2, 2 and 3, 3 and 4, 4 and 5, 5 and 6, 6 and 7, 7 and 8, and 8 and 1, respectively.

Figure 4:
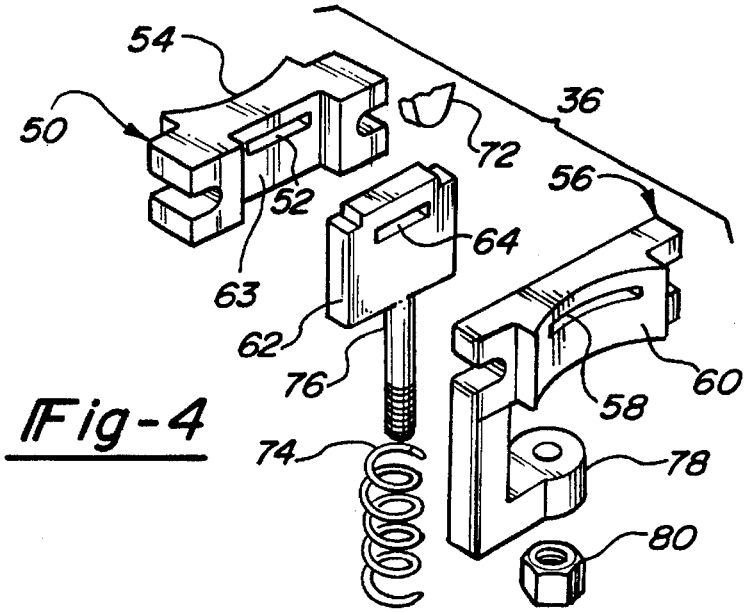
FIG. 4 is an exploded perspective view of the firing valve of this invention.

Each of the valves is uniquely constructed as shown by valve 36 in FIG. 4. Valve 36 includes a body portion 50 having a slotted entry port 52 which is in-line with the exit port 28 of cylinder 2 as the arcuate surface 54 of body portion 50 abuts against the exterior wall of cylinder 2. Valve 36 also includes a body portion 56 having a slotted outlet port 58 which is in-line with the inlet port 30 of cylinder 3 as the arcuate surface 60 of the body portion 56 abuts against the exterior wall of cylinder 3.

Valve element or valve plate 62 having a valve port 64 slides in seat recess 63 of body portion 50 bringing the valve port 64 in line with valve entry and outlet ports 52 and 58 and exit port 28 and inlet port 30. Valve body portions 50 and 56 are held together by bolts 66 as seen in FIG. 3.

The valves are actuated in a timed relationship by cams 68 on cam shaft 70. As the cam lobe 72 contacts valve element 62, it forces the element downward against the force of spring 74 on valve stem 76, acting against valve stop 78. Valve 36 is in its open position with ports 52, 64 and 58 aligned when the extremity of lobe 70 is in contact with element 62. Further rotation of the cam shaft brings the body of the cam 68 in line with valve element 62 which is pushed upward by spring 74 to move port 64 out of line with ports 52 and 58, closing the valve. Stop nut 80 on valve stem 76 in contact with valve stop 78 limits upward movement of the valve stem in the closed position of the valve.

In operation, firing is commenced by the use of a spark plug 82, shown by way of example in cylinder 2. Ignition would be commenced in the cylinder at maximum compression before the piston commences its downward travel as is well known in the art. Ignition having taken place in the combustion chamber 20 of cylinder 2, the combustion or flame front would be communicated or propagated to combustion chamber 22 of cylinder 3 through open valve 36 having ports 52, 64 and 58 in line with the exit port 28 of cylinder 2 and the inlet port 30 of cylinder 3. Ignition of the fuel air mixture in combustion chamber 22 of cylinder 3 would occur at maximum compression with valve 38 closing exit port 32 of cylinder 3 as well as valve 34 closing the inlet port to cylinder 2 as shown in FIG. 1. Serial ignition of the rest of the cylinders would take place in the same manner, sustaining ignition without further use of the spark plug. That is, ignition would occur in the combustion chamber 20 of cylinder 2 by combustion passing through valve 34 in the open position.

A simple means of controlling timing is shown in FIG. 2. As shown in FIG. 1, the cam shaft 70 supported in bearings 84 is driven by sprocket 86 on the cam shaft through timing chain 88 by sprocket 90 on the crank shaft 18; see FIG. 2. The angular position of the crank shaft's sprocket 90 can be finely adjusted by moving of timing yoke 92 in the directions indicated by arrow 94, which in turn moves the outer sprocket sleeve 96 with inclined slot 98 relative to the inner sleeve 100 with axial slot 102 with crank shaft pin 104 passing through both slots.

It will be apparent from the layout of the eight cylinder engine shown in FIG. 5 that the valves 34, 36 and 38 will be actuated by cam shaft 70 in line with these valves which, in turn, is actuated through the crank shaft 18 for cylinders 1 through 4 as seen in FIG. 1. Valve 40 between cylinders 4 and 5 can be actuated from the cam shaft 70, which actuates valves 34, 36 and 38, through a rocker arm having a follower in contact with a cam on cam shaft 70. Valves 42, 44 and 46 will be actuated from a cam shaft in line with a crank shaft for cylinders 5 through 8 with valve 48 being actuated through a rocker arm from this cam shaft.

It will be apparent that many different cylinder arrangements can be operated with varying valve structures and arrangements to provide continuing ignition of the cylinders by combustion passing between the cylinders in a closed loop.

I claim:

1. A firing system for a multi-cylinder internal combustion engine comprising:

inlet and exit ports adjacent the top of each cylinder;

passages interconnecting the inlet port of one cylinder with the exit port of another cylinder;

a valve in each of said passages; and means for sequentially opening and closing said valves, said means comprising a cam shaft positioned above a cylinder block of the engine and timing means interconnection said cam shaft with an engine crankshaft positioned below said cylinder block;

whereby combustion in a first cylinder commences combustion in a second cylinder by the combustion passing from the exit port of the first cylinder through one of said interconnecting passages and valves and through the inlet port of the second cylinder, said engine firing order proceeds sequentially and in a linear fashion from said first cylinder to a last of said cylinders and said system further including a passage and a valve extending between said last cylinder to an inlet port of said first cylinder thus sequentially firing all the cylinders; and wherein each of said valves comprises:

a removable first body portion having a side contiguous with said first cylinder and having an entry port in-line with said inlet port;

a second body portion having a side contiguous with said second cylinder and having an outlet port in-line with said exit port; and a valve plate arranged to slide in a seat recess formed by said first and second body portions, said plate having a valve port in-line with said entry and outlet ports when said valve is in its open position.

2. The firing system according to claim 1 including a spark plug in one of said cylinders for initiating combustion.

3. The firing system according to claim 1 wherein said means for sequentially opening and closing said valves includes a cam shaft operating in synchronism with an engine crank shaft.

4. The firing system according to claim 1 wherein said engine is an eight cylinder, two cycle engine with a cylinder firing order of one, two, three, four, five, six, seven, eight, and said firing system utilizes eight passages and eight valves with a passage and valve between the exit port of cylinder eight and the inlet port of cylinder one.

5. The firing system according to claim 1, said timing means comprising a timing chain extending from a first sprocket of said cam shaft and connecting to a second sprocket of said crank shaft.

6. The firing system according to claim 5, further comprising a timing yoke for adjusting an angular position of said second sprocket.

7. The firing system according to claim 6, said second sprocket further comprising an outer sleeve having an inclined slot relative to an inner sleeve having an axial slot, a crank shaft pin passing through both slots.

* * * * *